US010765909B2

(12) United States Patent
Wiegman

(10) Patent No.: US 10,765,909 B2
(45) Date of Patent: Sep. 8, 2020

(54) CALF EXERCISING ASSEMBLY

(71) Applicant: James Wiegman, Long Beach, CA (US)

(72) Inventor: James Wiegman, Long Beach, CA (US)

( * ) Notice: Subject to any disclaimer, the term of this patent is extended or adjusted under 35 U.S.C. 154(b) by 109 days.

(21) Appl. No.: 15/787,870

(22) Filed: Oct. 19, 2017

(65) Prior Publication Data

US 2019/0118027 A1 Apr. 25, 2019

(51) Int. Cl.

| | |
|---|---|
| ***A63B 23/04*** | (2006.01) |
| ***A63B 21/072*** | (2006.01) |
| ***A63B 23/035*** | (2006.01) |
| ***A63B 23/08*** | (2006.01) |
| ***A63B 21/00*** | (2006.01) |

(52) U.S. Cl.

CPC ..... *A63B 21/4027* (2015.10); *A63B 21/0724* (2013.01); *A63B 21/4033* (2015.10); *A63B 21/4034* (2015.10); *A63B 21/4043* (2015.10); *A63B 23/03525* (2013.01); *A63B 23/0405* (2013.01); *A63B 23/085* (2013.01); *A63B 2208/0233* (2013.01)

(58) Field of Classification Search

CPC . A63B 21/4027; A63B 21/0724; A63B 21/06; A63B 21/0601; A63B 21/072; A63B 21/0728; A63B 21/00047; A63B 21/00058; A63B 21/00061; A63B 21/00065; A63B 21/0726; A63B 21/0405; A63B 21/4039; A63B 23/00; A63B 23/0405; A63B 23/035; A63B 23/03516; A63B 23/03508; A63B 23/0355; A63B 23/04; A63B 23/0458; A63B 23/047; A63B 23/08; A63B 23/085; A63B 2208/0233; A63B 2208/0209; A63B 2023/0411

See application file for complete search history.

(56) References Cited

U.S. PATENT DOCUMENTS

| | | | | |
|---|---|---|---|---|
| 4,867,444 | A | 9/1989 | Castillo | |
| 5,058,886 | A * | 10/1991 | Jackson | A63B 21/0724 224/222 |
| 5,342,272 | A * | 8/1994 | Pittroff | A63B 21/072 224/265 |
| 6,224,518 | B1 | 5/2001 | Weiss et al. | |
| 7,223,217 | B1 | 5/2007 | Liao | |
| D688,338 | S | 8/2013 | Bisson | |
| 8,647,238 | B2 * | 2/2014 | Lepore | A63B 23/0458 482/52 |
| 2002/0072455 | A1 | 6/2002 | Akins | |
| 2002/0193210 | A1 | 12/2002 | Turner | |

(Continued)

FOREIGN PATENT DOCUMENTS

| | | | | |
|---|---|---|---|---|
| GB | 2484975 A * | 5/2012 | | A63B 23/0405 |

*Primary Examiner* — Loan B Jimenez
*Assistant Examiner* — Zachary T Moore

(57) ABSTRACT

A calf exercising assembly for performing seated calf exercises includes a pair of blocks that is each selectively positioned on support surface thereby facilitating a user's feet to be positioned thereon. Each of the blocks spaces the user's heel from the support surface thereby facilitating the user to perform seated calf exercises. A yoke is provided and the yoke is coupled to a weight. Additionally, the yoke is positioned on the user's thighs thereby facilitating the user to perform seated calf raises.

5 Claims, 10 Drawing Sheets

(56) References Cited

U.S. PATENT DOCUMENTS

| | | | | |
|---|---|---|---|---|
| 2006/0258516 | A1* | 11/2006 | Nolte | A63B 21/00047 482/92 |
| 2009/0111667 | A1 | 4/2009 | Dimucci, III | |
| 2009/0192022 | A1* | 7/2009 | Kulka | A63B 21/153 482/46 |
| 2011/0092341 | A1* | 4/2011 | Schneider | A63B 21/072 482/93 |
| 2014/0194259 | A1 | 7/2014 | Alpert | |
| 2018/0339192 | A1* | 11/2018 | Bujold | A63B 23/04 |

* cited by examiner

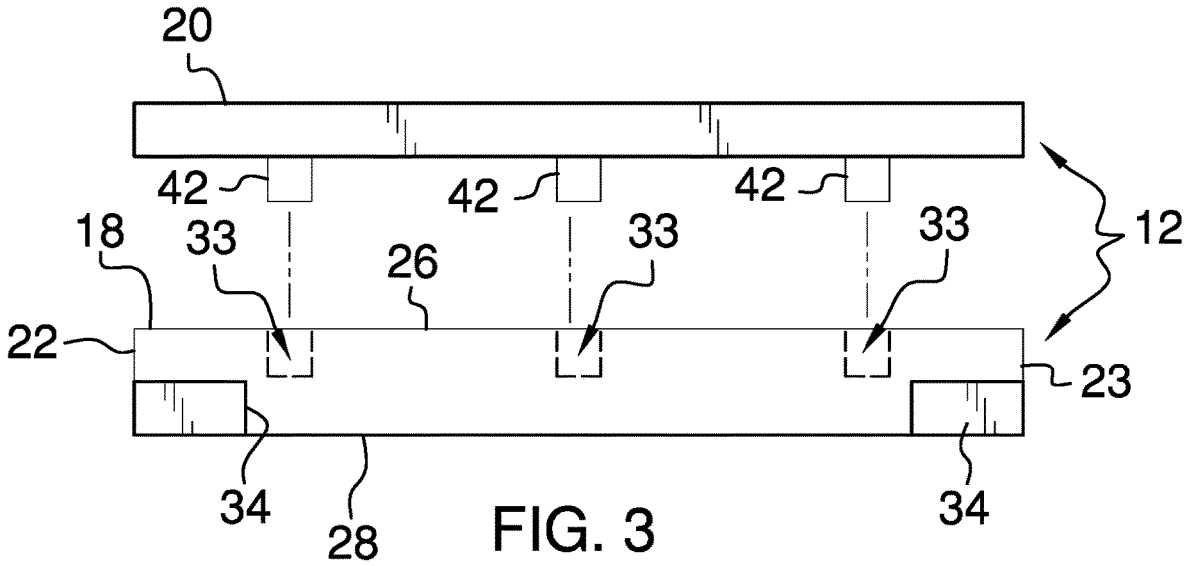
FIG. 3
FIG. 4
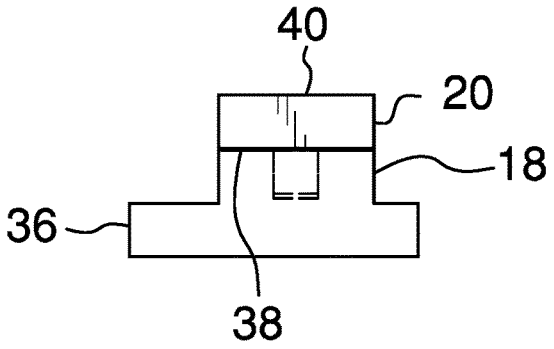

CALF EXERCISING ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to exercising devices and more particularly pertains to a new exercising device for performing seating calf exercises.

(2) Description of Related Art Including Information Disclosed Under 37 CFR 1.97 and 1.98

The prior art relates to exercising devices.

BRIEF SUMMARY OF THE INVENTION

An embodiment of the disclosure meets the needs presented above by generally comprising a pair of blocks that is each selectively positioned on support surface thereby facilitating a user's feet to be positioned thereon. Each of the blocks spaces the user's heel from the support surface thereby facilitating the user to perform seated calf exercises. A yoke is provided and the yoke is coupled to a weight. Additionally, the yoke is positioned on the user's thighs thereby facilitating the user to perform seated calf raises.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein:

FIG. 3 is a phantom exploded view of a pair of blocks of an embodiment of the disclosure.

FIG. 4 is a right side phantom view of a pair of blocks of an embodiment of the disclosure.

DETAILED DESCRIPTION OF THE INVENTION

Figure 1:
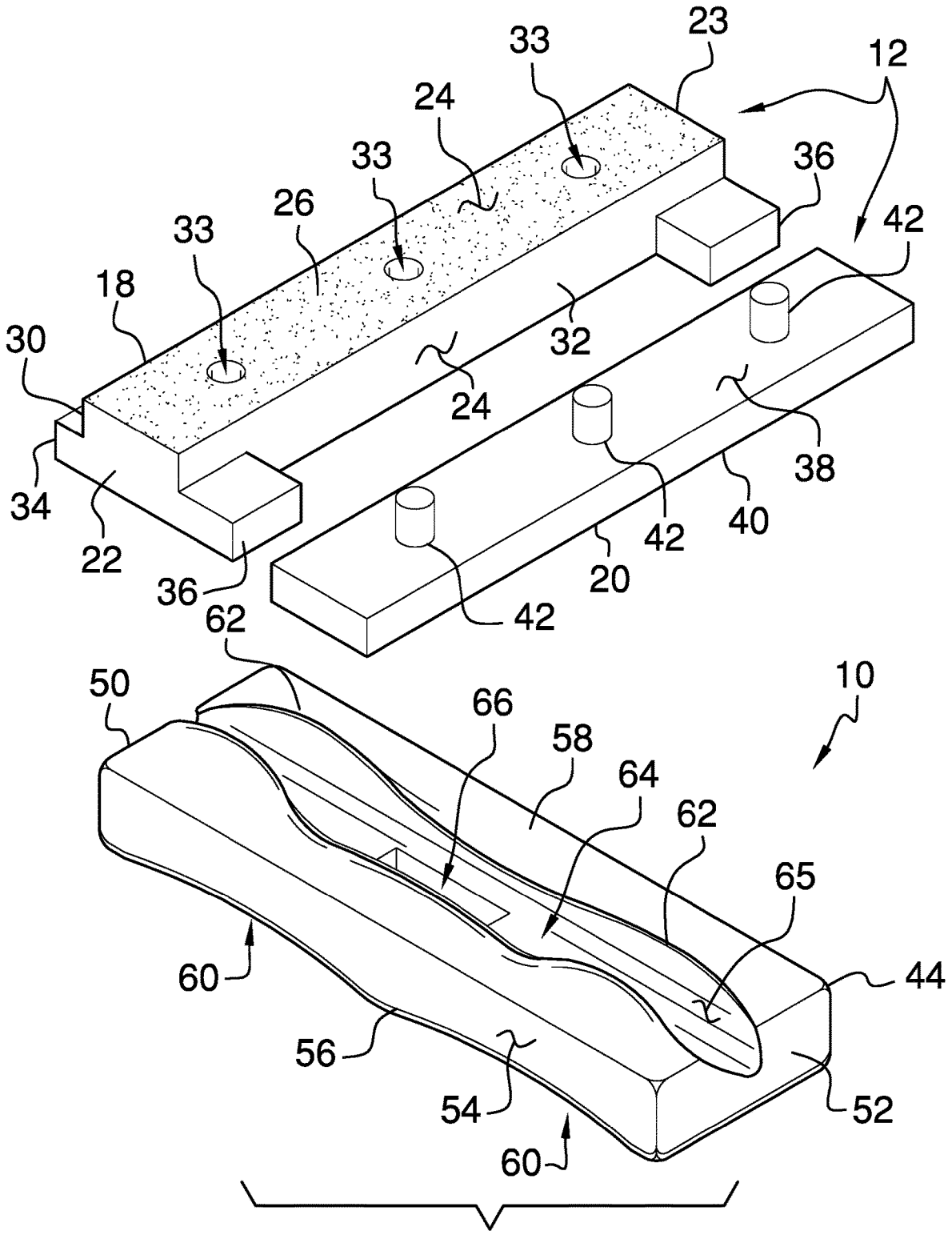
FIG. 1 is a perspective view of a calf exercising assembly according to an embodiment of the disclosure.
Figure 2:
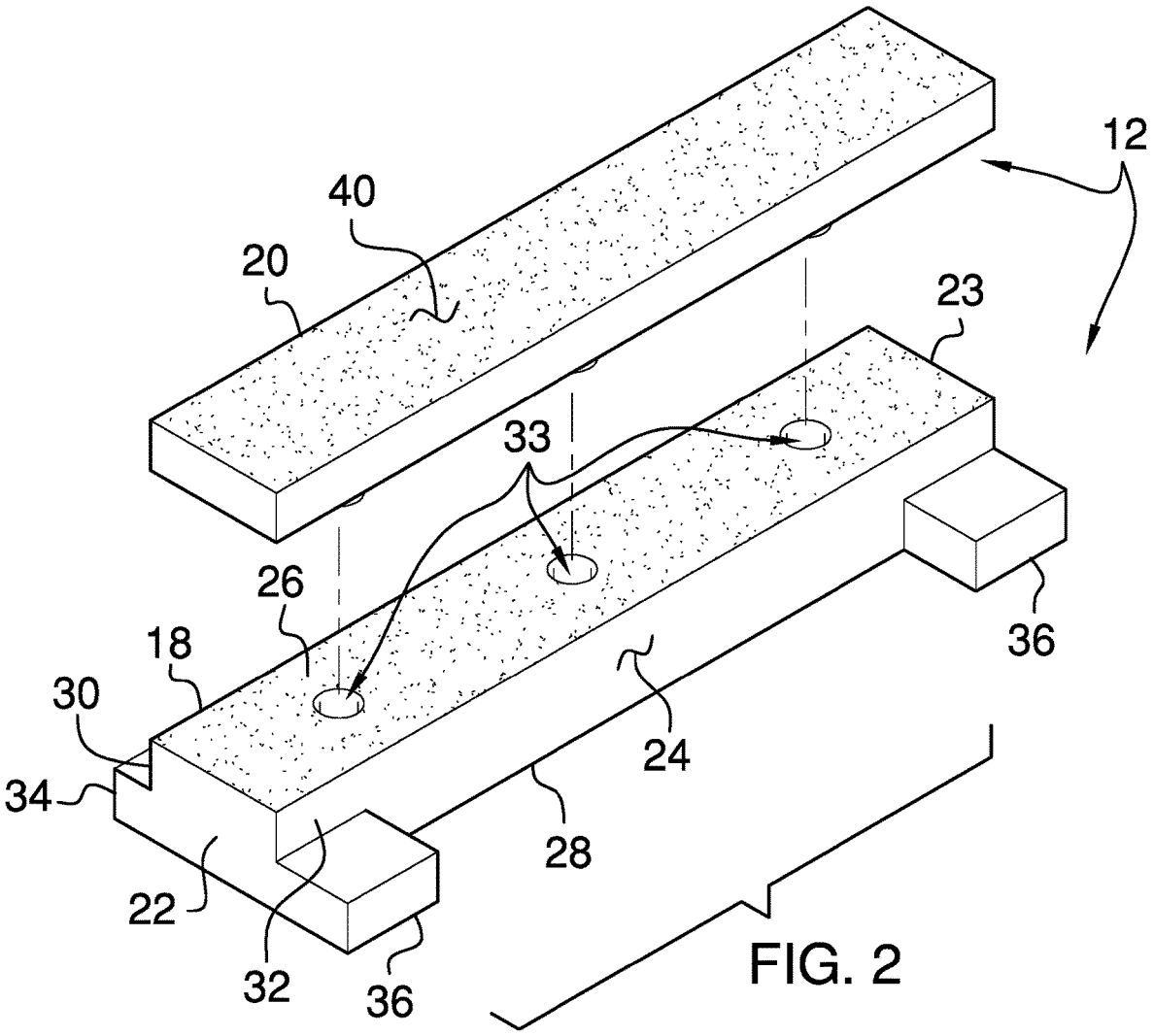
FIG. 2 is an exploded perspective view of pair of blocks of an embodiment of the disclosure.
Figure 5:
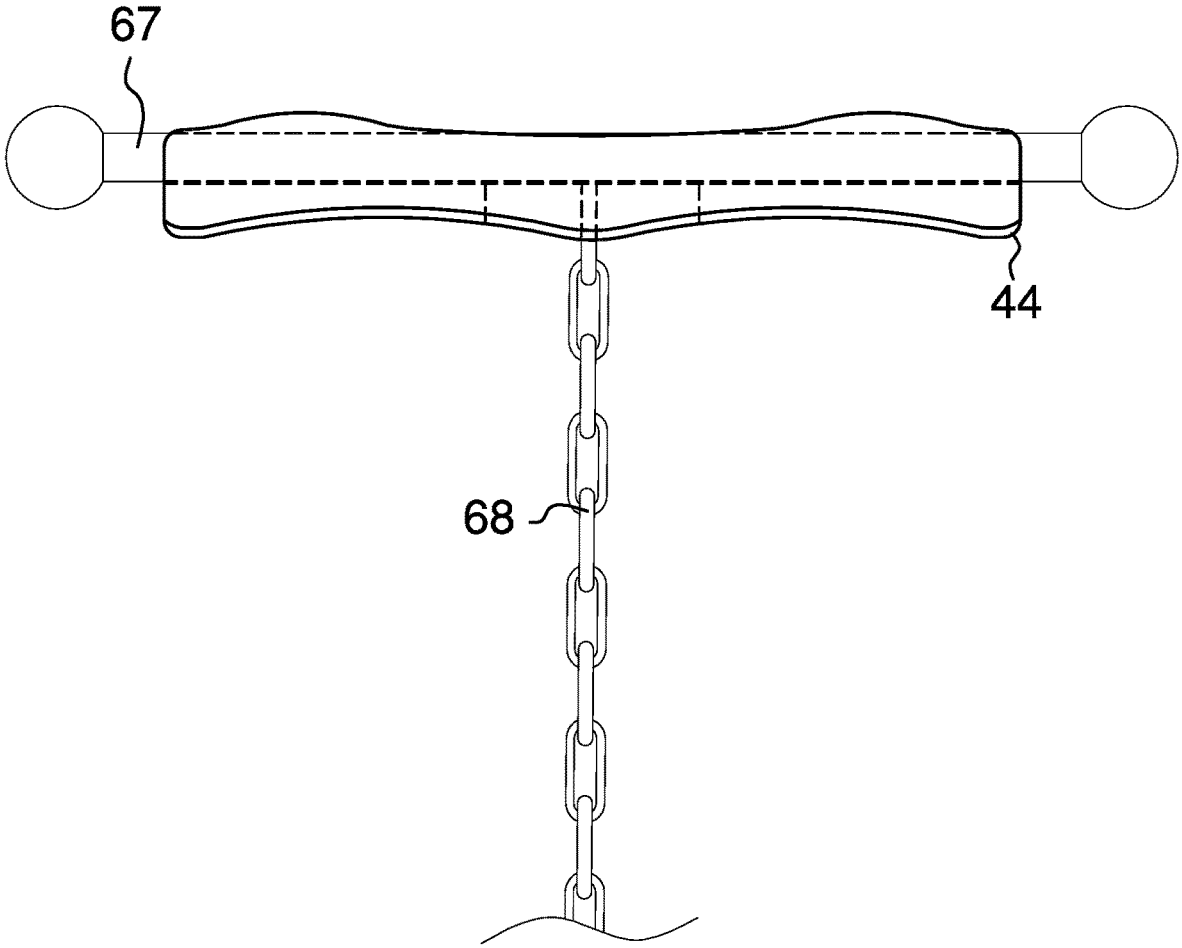
FIG. 5 is a phantom in-use view of an embodiment of the disclosure.
Figure 6:
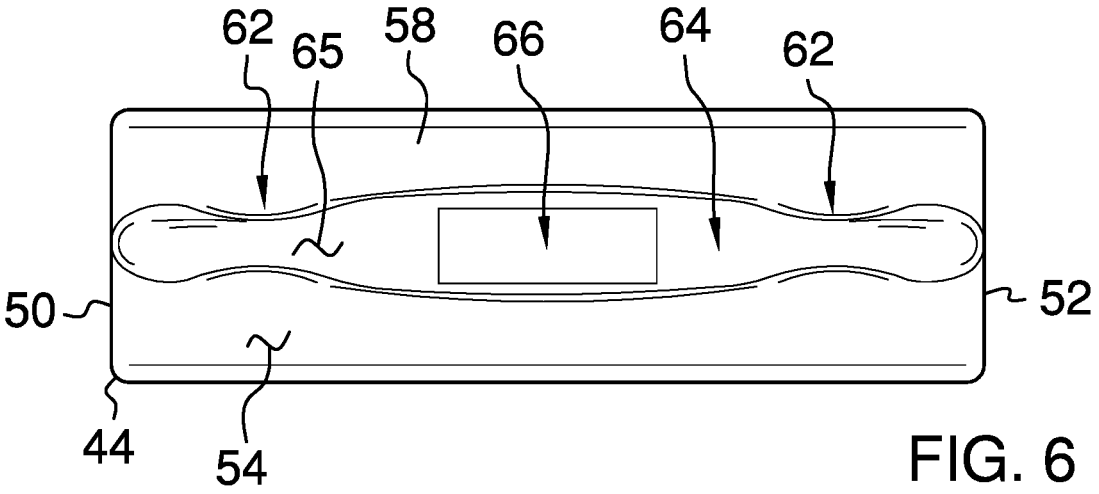
FIG. 6 is a top view of a yoke of an embodiment of the disclosure.
Figure 7:
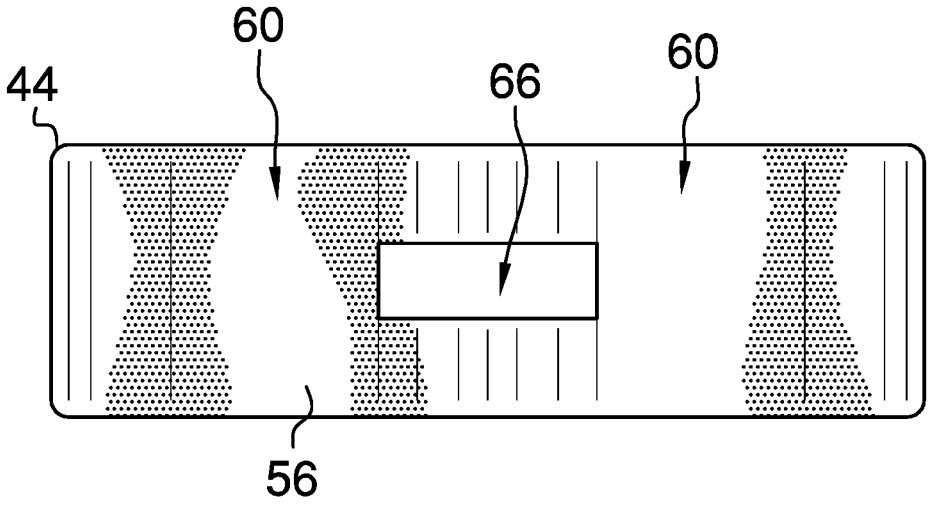
FIG. 7 is a bottom view of a yoke of an embodiment of the disclosure.
Figure 8:
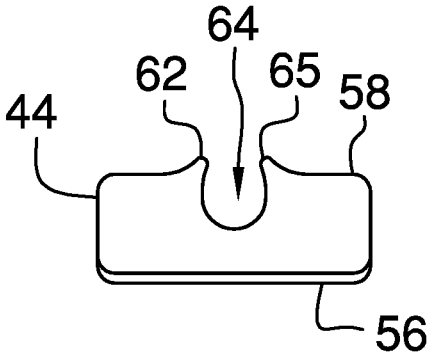
FIG. 8 is a right side view of yoke of an embodiment of the disclosure.
Figure 9:
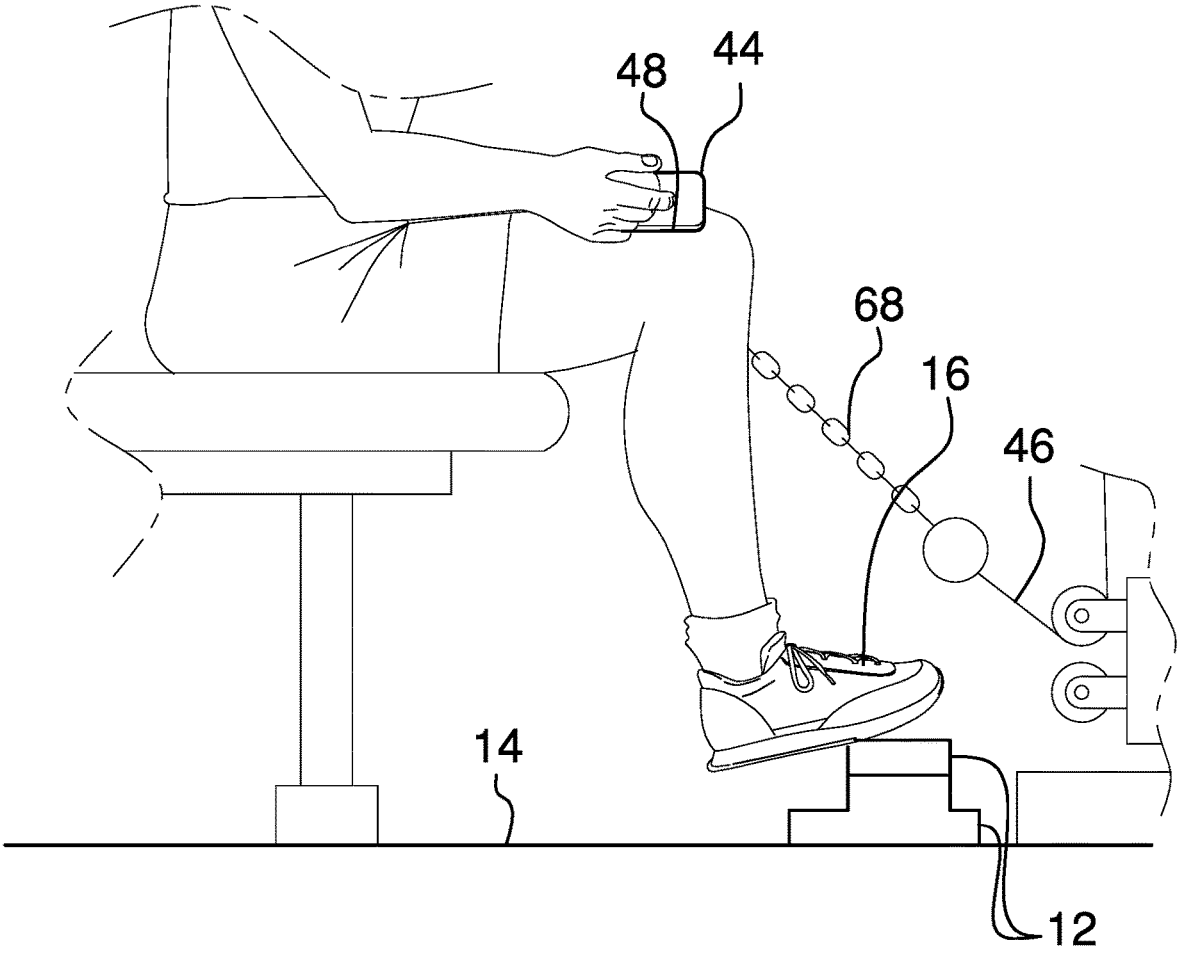
FIG. 9 is a perspective in-use view of an embodiment of the disclosure.
Figure 10:
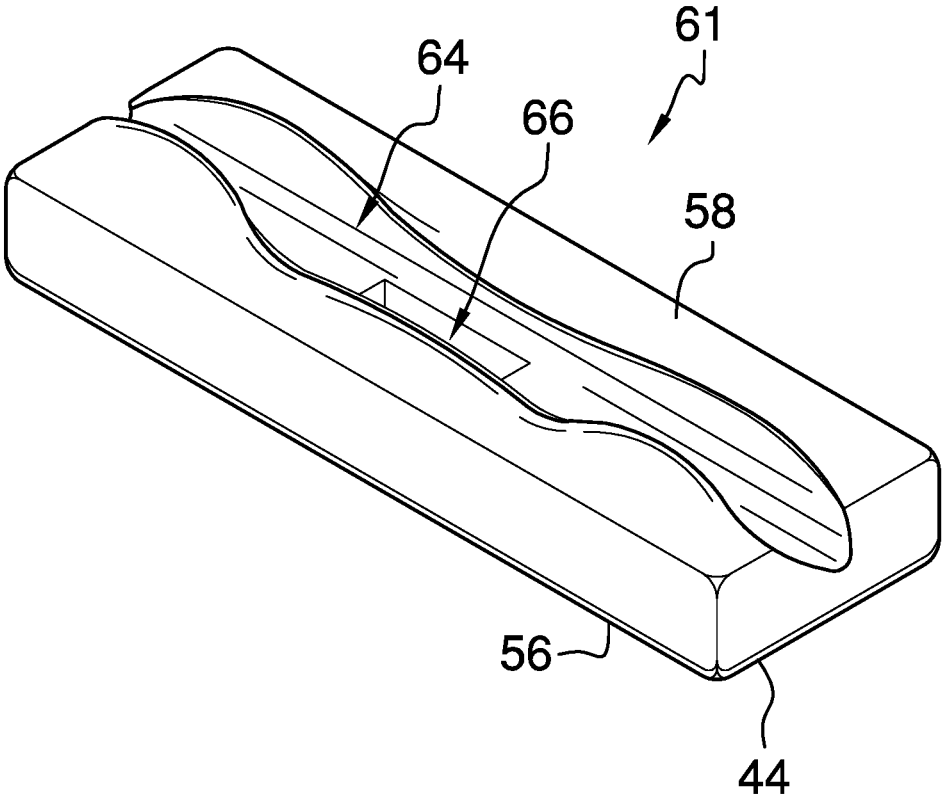
FIG. 10 is a perspective view of yoke of an alternative embodiment of the disclosure.
Figure 11:
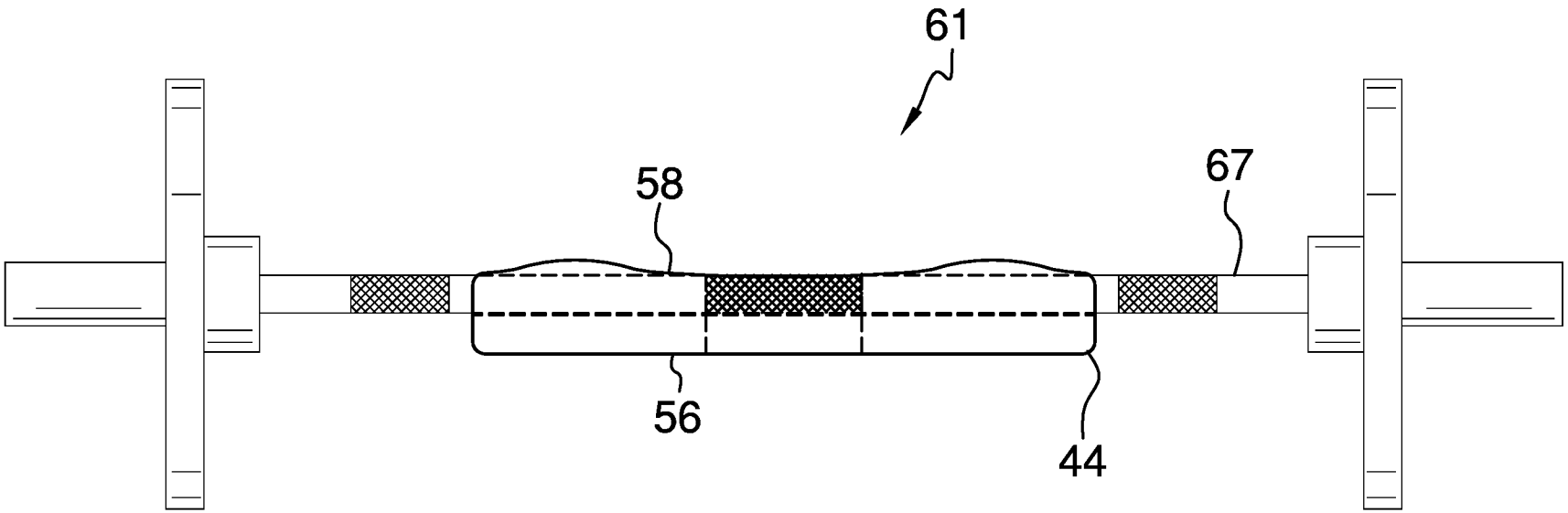
FIG. 11 is a phantom in-use view of a yoke of an alternative embodiment of the disclosure.
Figure 12:
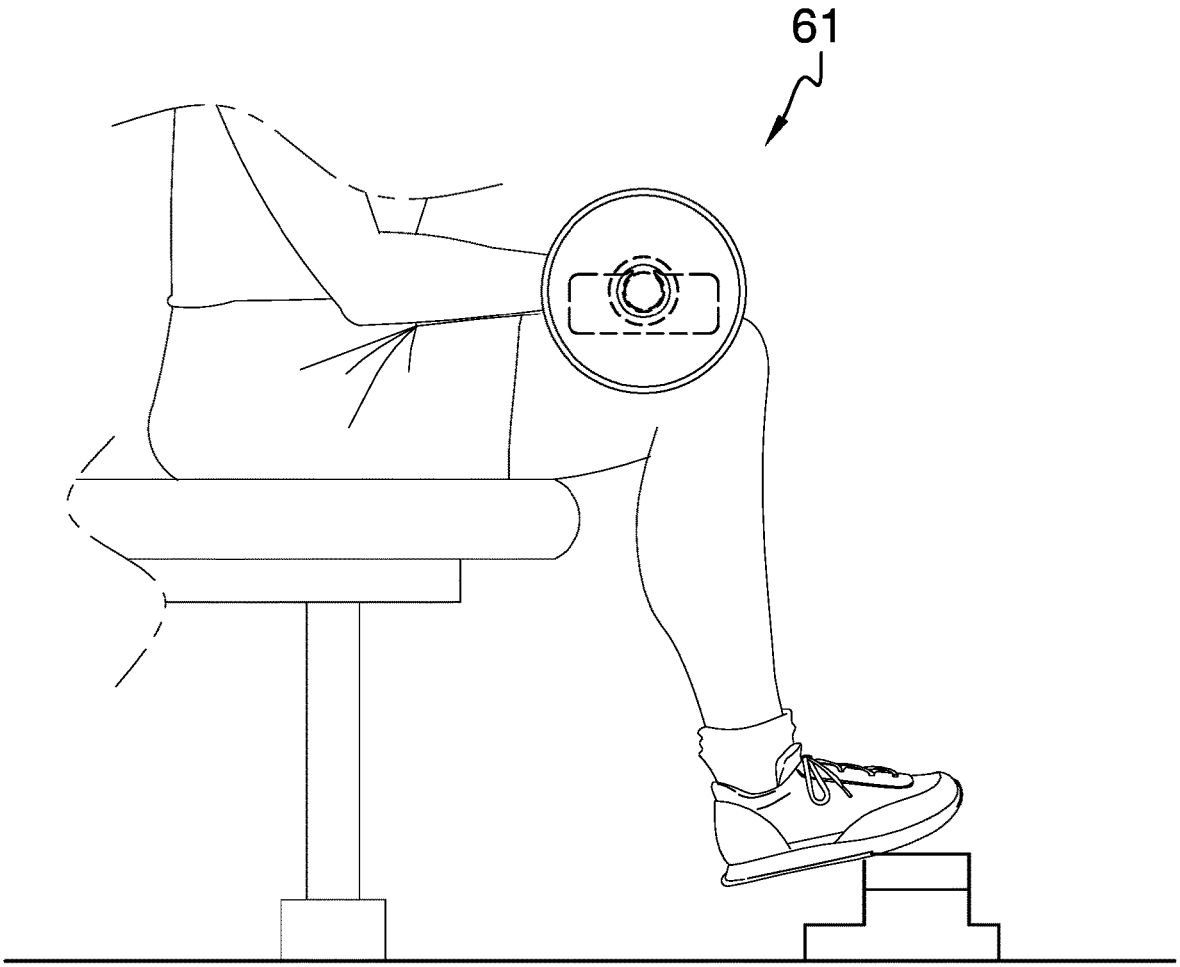
FIG. 12 is a perspective in-use view of a yoke of an alternative embodiment of the disclosure.
Figure 13:
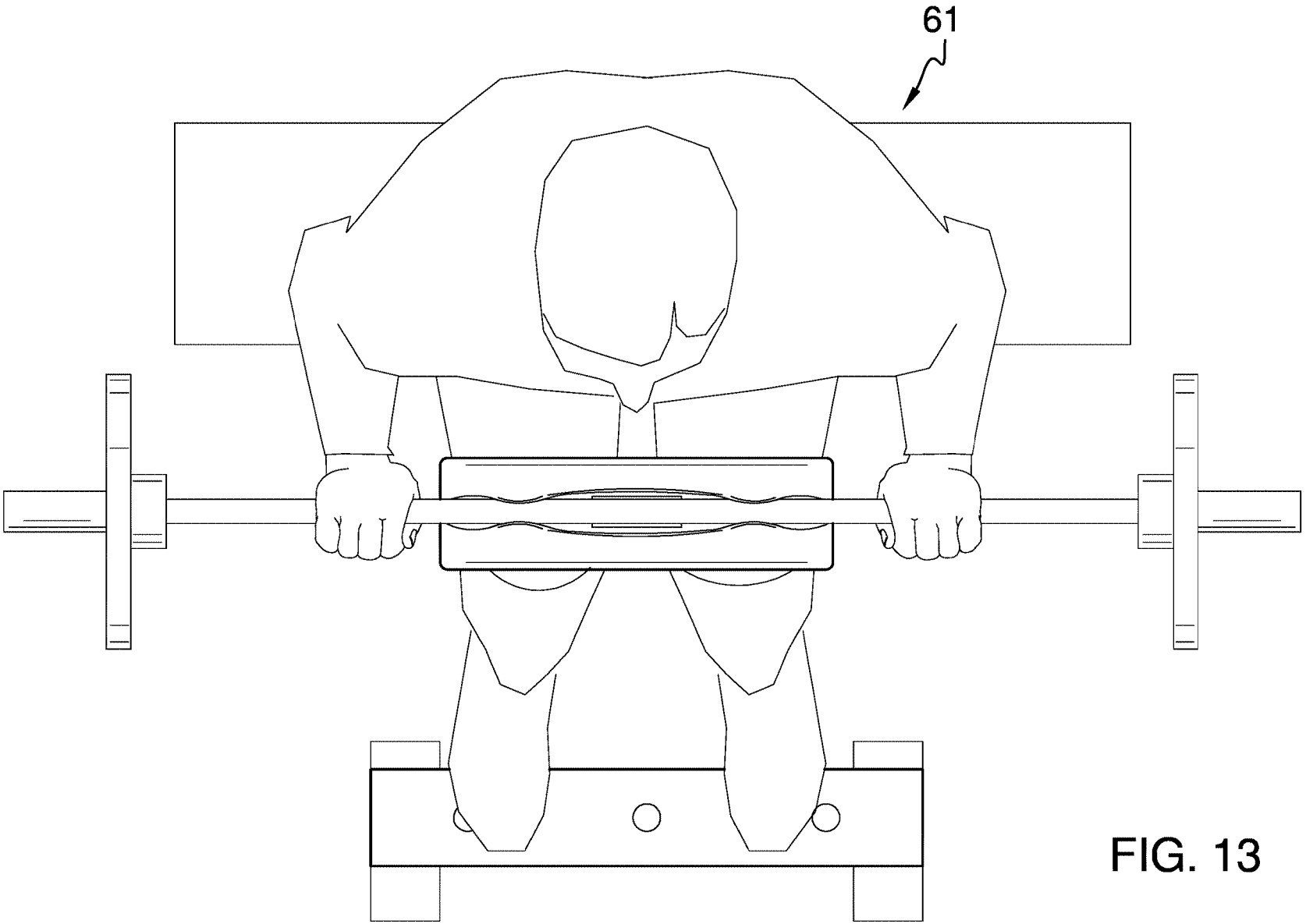
FIG. 13 is a top in-use view of yoke of an alternative embodiment of the disclosure.

With reference now to the drawings, and in particular to FIGS. 1 through 13 thereof, a new exercising device embodying the principles and concepts of an embodiment of the disclosure and generally designated by the reference numeral 10 will be described.

As best illustrated in FIGS. 1 through 13, the calf exercising assembly 10 generally comprises a pair of blocks 12 that is each selectively positioned on support surface 14 such as a floor or the like. Each of a user's feet 16 is selectively positioned on the blocks 12 to space the user's heel from the support surface 14. In this way the user's feet 16 are positioned to perform calf exercises. The pair of blocks 12 includes a first block 18 and a second block 20.

The first block 18 has a first end 22, a second end 23 and an outer surface 24 extending therebetween. The first block 18 is elongated between the first end 22 and the second end 23, and the outer surface 24 has a top side 26, bottom side 28, a first lateral side 30 and a second lateral side 32. The top side 26 has a plurality of wells 33 extending toward the bottom side 28. The wells 33 are spaced apart from each other and are distributed between the first end 22 and the second end 23. The bottom side 28 abuts the support surface 14 when the first block 18 is positioned on the support surface 14. The top side 26 of the first block 18 may be textured thereby enhancing gripping the top side 26.

A pair first feet 34 is provided and each of the first feet 34 is coupled to and extends laterally away from the first lateral side 30 of the first block 18. The first feet 34 are spaced apart from each other and each of the first feet 34 is aligned with the bottom side 28 of the first block 18 for stabilizing the first block 18 on the support surface 14. A pair second feet 36 is provided and each of the second feet 36 is coupled to and extends laterally away from the second lateral side 32 of the first block 18. The second feet 36 are spaced apart from each other and each of the second feet 36 is aligned with the bottom side 28 of the first block 18 to stabilize the first block 18 on the support surface 14. Each of the second feet 36 has a length that is greater than a length of each of the first feet 34.

The second block 20 has an upper surface 38 and a bottom surface 40. A plurality of pins 42 is provided and each of the pins 42 is coupled to and extends away from the bottom surface 40 of the second block 20. Each of the pins 42 engages an associated one of the wells 33 in the first block 18. Thus, the second block 20 is oriented to be coextensive with the first block 18 thereby increasing a spacing between the user's heel and the support surface 14 with respect to the first block 18. The upper surface 38 of the second block 20 may be textured thereby enhancing gripping the upper surface 38.

A yoke 44 is provided and the yoke 44 is selectively coupled to a weight 46. The weight 46 may be a free weight, a weight in a weight machine and any other weight commonly employed to strength training. The yoke 44 is selectively positioned on the user's thighs 48 thereby facilitating the user to perform seated calf raises. Moreover, the yoke 44 may comprised of a rigid material and the yoke 44 may be wrapped in a cushion or the like to enhance comfort on the user's thighs 48.

The yoke 44 has a primary end 50, a secondary end 52 and an outside surface 54 extending therebetween and the yoke 44 is elongated between the primary end 50 and the secondary end 52. The outside surface 54 has a first side 56 and a second side 58, and the first side 56 undulates between the primary end 50 and the secondary end 52 to define a pair of valleys 60 on the first side 56. Each of the valleys 60 conforms to the user's thighs 48 when the yoke 44 is positioned on the user's thighs 48. In an alternative embodiment 61 as shown in FIGS. 10 through 13, the first side 56 may be flat.

The second side 58 has a pair of prominences 62 extending away therefrom and the prominences 62 are spaced apart from each other. The second side 58 has a slot 64 extending toward the first side 56 and the slot 64 extends through each of the primary end 50 and the secondary end 52. The slot 64 has a bounding surface 65 and the bounding surface 65 is concavely arcuate with respect to the second side 58. Moreover, the slot 64 insertably receives a bar 67 on a weight machine. The slot 64 is centrally positioned on the yoke 44 such that the slot 64 bisects each of the prominences 62 wherein. Thus, each of the prominences 62 inhibits the bar 67 from sliding out of the slot 64.

The yoke 44 has an aperture 66 extending through the first side 56 and the second side 58. A coupling 68 that extends between the bar and a weight 46 on the weight 46 machine is extended through the aperture 66. The aperture 66 is centrally positioned on the yoke 44 such that the aperture 66 is centrally positioned in the slot 64. The coupling 68 may be a chain, a cable, a rope and any other flexible coupling 68 commonly found on a weight 46 machine.

In use, the first block 18 is positioned on the support surface 14 to space the user's feet 16 from the support surface 14. The second block 20 is selectively placed on the first block 18 to increase the distance between the user's feet 16 and the support surface 14. The bar 67 is positioned in the slot 64 and the coupling 68 is extended through the aperture 66 and coupled to the bar. The yoke 44 is positioned on the user's thighs 48 thereby facilitating the weight 46 to provide resistance for seated calf raises and other calf exercises. Alternatively, a bar 67 for free weights is selectively positioned in the slot 64 thereby facilitating free weights to provide the resistance for the calf exercises.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A calf exercising assembly being configured to exercise calf muscles on legs, said assembly comprising:

a pair of blocks, each of said blocks being configured to be selectively positioned on a support surface thereby facilitating a user's feet to be positioned thereon, each of said blocks being configured to space the user's heel from the support surface thereby facilitating the user to perform seated calf exercises, said pair of blocks includes a first block and a second block, said first block having a first end, a second end and an outer surface extending therebetween, said first block being elongated between said first end and said second end, said outer surface having a top side, bottom side, a first lateral side and a second lateral side, said top side having a plurality of wells extending toward said bottom side, said wells being spaced apart from each other and being distributed between said first end and said second end, said bottom side being configured to abut the support surface when said first block is positioned on the support surface, said second block having an upper surface and a bottom surface;

a yoke being configured to be coupled to a weight, said yoke being configured to be positioned on the user's thighs thereby facilitating the user to perform seated calf raises; and a pair first feet, each of said first feet being coupled to and extending laterally away from said first lateral side of said first block, said first feet being spaced apart from each other, each of said first feet being aligned with said bottom side of said first block wherein each of said first feet is configured to stabilize said first block on the support surface;

wherein said yoke has a primary end, a secondary end and an outside surface extending therebetween, said yoke being elongated between said primary end and said secondary end, said outside surface having a first side and a second side, said first side undulating between said primary end and said secondary end to define a pair of valleys on said first side wherein each of said valleys is configured to conform to the user's thighs;

wherein said second side has a pair of prominences extending away therefrom, said prominences being spaced apart from each other; and wherein said second side has a slot extending toward said first side, said slot extending through each of said primary end and said secondary end wherein said slot is configured to insertably receive a bar on a weight machine, said slot being centrally positioned on said yoke such that said slot bisects each of said prominences wherein each of said prominences is configured to inhibit the bar from sliding out of said slot.

2. The assembly according to claim 1, further comprising a pair of second feet, each of said second feet being coupled to and extending laterally away from said second lateral side of said first block, said second feet being spaced apart from each other, each of said second feet being aligned with said bottom side of said first block wherein each of said second feet is configured to stabilize said first block on the support surface, each of said second feet having a length being greater than the length of each of said first feet.

3. The assembly according to claim 1, further comprising a plurality of pins, each of said pins being coupled to and extending away from said bottom surface of said second block, each of said pins engaging and associated one of said wells in said first block such that said second block is oriented to be coextensive with said first block wherein said second block is configured to increase a spacing between the user's heel and the support surface with respect to said first block.

4. The assembly of claim 1, wherein said yoke has an aperture extending through said first side and said second side wherein said aperture is configured to receive a coupling extending between the bar and a weight on the weight machine, said aperture being centrally positioned on said yoke such that said aperture is centrally positioned in said slot.

5. A calf exercising assembly being configured to exercise calf muscles on legs, said assembly comprising:

a pair of blocks, each of said blocks being configured to be selectively positioned on a support surface thereby facilitating a user's feet to be positioned thereon, each of said blocks being configured to space the user's heel from the support surface thereby facilitating the user to perform calf exercises, said pair of blocks including a first block and a second block, said first block having a first end, a second end and an outer surface extending therebetween, said first block being elongated between said first end and said second end, said outer surface having a top side, bottom side, a first lateral side and a second lateral side, said top side having a plurality of wells extending toward said bottom side, said wells being spaced apart from each other and being distributed between said first end and said second end, said bottom side being configured to abut the support surface when said first block is positioned on the support surface, said second block having an upper surface and a bottom surface;

a pair first feet, each of said first feet being coupled to and extending laterally away from said first lateral side of said first block, said first feet being spaced apart from each other, each of said first feet being aligned with said bottom side of said first block wherein each of said first feet is configured to stabilize said first block on the support surface;

a pair of second feet, each of said second feet being coupled to and extending laterally away from said second lateral side of said first block, said second feet being spaced apart from each other, each of said second feet being aligned with said bottom side of said first block wherein each of said second feet is configured to stabilize said first block on the support surface, each of said second feet having a length being greater than the length of each of said first feet;

a plurality of pins, each of said pins being coupled to and extending away from said bottom surface of said second block, each of said pins engaging and associated one of said wells in said first block such that said second block is oriented to be coextensive with said first block wherein said second block is configured to increase a spacing between the user's heel and the support surface with respect to said first block; and a yoke being configured to be coupled to a weight, said yoke being configured to be positioned on the user's thighs thereby facilitating the user to perform calf raises, said yoke having a primary end, a secondary end and an outside surface extending therebetween, said yoke being elongated between said primary end and said secondary end, said outside surface having a first side and a second side, said first side undulating between said primary end and said secondary end to define a pair of valleys on said first side wherein each of said valleys is configured to conform to the user's thighs, said second side having a pair of prominences extending away therefrom, said prominences being spaced apart from each other, said second side having a slot extending toward said first side, said slot extending through each of said primary end and said secondary end wherein said slot is configured to insertably receive a bar on a weight machine, said slot being centrally positioned on said yoke such that said slot bisects each of said prominences wherein each of said prominences is configured to inhibit the bar from sliding out of said slot, said yoke having an aperture extending through said first side and said second side wherein said aperture is configured to receive a coupling extending between the bar and a weight on the weight machine, said aperture being centrally positioned on said yoke such that said aperture is centrally positioned in said slot.

* * * * *